United States Patent [19]

Farkas et al.

[11] Patent Number: 4,889,975

[45] Date of Patent: Dec. 26, 1989

[54] SELF-REGULATING HEATER HAVING A HEAT TAPE THAT STOPS TRACKING

[75] Inventors: Richard W. Farkas, Stow; David A. Rock, Ravenna; James H. Anderson, Massillon, all of Ohio

[73] Assignee: The Fluorocarbon Company, Aurora, Ohio

[21] Appl. No.: 168,650

[22] Filed: Mar. 16, 1988

[51] Int. Cl.[4] ..... H05B 3/10

[52] U.S. Cl. ..... 219/548; 219/505; 29/611

[58] Field of Search ..... 219/546, 548, 504, 505; 29/611; 338/214; 174/117 F, 117 AS

[56] References Cited

U.S. PATENT DOCUMENTS

| | | | |
|---|---|---|---|
| 2,626,303 | 1/1953 | Link | 174/117 AS |
| 3,243,753 | 3/1966 | Kohler | 338/31 |
| 3,823,217 | 7/1974 | Kampe | 29/611 |
| 3,861,029 | 1/1975 | Smith-Johanssen et al. | 29/611 |
| 3,914,363 | 10/1975 | Bedard et al. | 29/611 |
| 4,200,973 | 5/1980 | Farkas | 29/611 |
| 4,271,350 | 6/1981 | Crowley | 219/549 |

*Primary Examiner*—A. D. Pellinen
*Assistant Examiner*—Leon K. Fuller
*Attorney, Agent, or Firm*—Fay, Sharpe, Beall, Fagan, Minnich & McKee

[57] ABSTRACT

A phenomenon sometimes referred to as tracking can occur when the end of an electrical heater, made of two or more metal conductors and a conductive polymer web, comes into contact with water or other electrolytes which allow arcing to take place across the surface of the web. Tracking is stopped by holes in the web which prevent arcing from continuing up the length of the heat tape.

12 Claims, 1 Drawing Sheet

SELF-REGULATING HEATER HAVING A HEAT TAPE THAT STOPS TRACKING

BACKGROUND OF THE INVENTION

A self regulating heater is essentially two conductors connected by a polymeric material filled with electrically conductive particles. The conductors are connected to an electrical power source which causes current to flow through the conductive polymer compound. Electrical resistance heating causes the compound to warm, thus causing the polymeric matrix to expand. The expanding polymeric matrix, in turn, causes the electrically conductive particles to separate, thereby reducing the conductivity of the compound. As a result, the current and thus the power output of the heater, is automatically limited at the warmer temperature. This allows the heater to be used without the use of external temperature sensors, controllers, etc.

A phenomenon, sometimes called tracking, can occur when the end of a heater, made of two or more metal conductors and a conductive polymer compound web that connects the conductors, comes into contact with water or other electrolytes. Tracking occurs when an electrolyte allows electrical arcing from one conductor, across the surface of the conductive polymer compound, to the other conductor. Such arcing chars the conductive polymer material, and consumes new material as it continues to propagate up the length of the heater. Excessive heat from the material in the active arcing area can ignite combustible materials in contact with the heater. This potentially dangerous condition can lead to a fire commonly referred to as a "wet" electrical fire.

Tracking can begin for a number of reasons. For example, if one conductor is broken, and the broken ends are in close proximity to each other, arcing between the ends will occur. This will char the material in the area of the broken conductor, which can eventually spread to the non-broken conductor, thereby beginning tracking up the length of the heater.

There have been many reported instances of self-regulated parallel circuitry heat tapes catching fire on industrial sites and burning along like a fuse or a firecracker, exploding at intervals. Such "wet fires" most commonly begin internally, due to the ingress of moisture or other electrolytes into the heater. This can result from a variety of reasons, including damage to the thermal insulation during installation; aging of the hot end termination, splices or tees; condensation falling onto semi-exposed heat tape with an aged or damaged sheath; or water entering and filling a junction box, contacting the nonwaterproof end of the tape.

In addition to the large number of wet fires caused by arcing faults in self-regulating tapes on industrial sites, a computer print out, issued by the U.S. Consumer Products Safety Commission, reported 480 instances of domestic heat tape fires in the four winter periods of October through March, 1981-82, 1982-83, 1983-84 and 1984-85. The fires averaged 120 per year or 20 per month for the six month winter periods, and in eight of those instances, one life was taken, for a total of eight deaths. The majority of the fires were caused by heat tapes burning under mobile homes where they were attached to cold water inlet pipes.

As with any electrical equipment or wiring installation at line voltage, insulation damage permitting water, or any electrolyte, to penetrate and form conductive paths of the system can lead to electrical tracking and arcing. The fault current associated with such arcing may be so small that conventional circuit breakers will not be tripped. For this reason, conventional ground fault protective devices of a nominal trip have been recommended to be used in conjunction with such heaters. The problem with using such protective devices, however, is that leakage current to ground is always present, and increases in proportion to the heat tape length, which can lead to false or nuisance tripping of the ground fault device. Therefore, many prefer to run the risk of wet fires rather than be plagued with nuisance tripping of the ground fault protector.

Accordingly, in the interest of consumer safety, there is a need for a self-regulating heater having a heat tape that will stop tracking, and thereby avoid the possible fire hazards associated therewith.

SUMMARY OF THE INVENTION

The present invention comprises a self-regulating heater tape including a pair of electrical conductors, extending in substantially parallel relation. An electrically semi-conductive compound surrounds the conductors, and forms a web therebetween. The compound is selected such that it will conduct current between the conductors at low temperatures, such that the conductors and the compound form a useful electrical heater.

The semi-conductive compound has a positive temperature coefficient of electrical resistance associated therewith, and is characterized in that the electrical resistance increases at higher temperatures. Thus, as the temperature increases, the heat output from the heater will be reduced, thereby providing a self regulating heater.

Experimentation has shown that the heater can be made to stop tracking from continuing up the length of the heater, once it has started, by introducing a break or discontinuity in the conductive polymer web. Such discontinuity can be made by cutting a hole or a slit in the heater's web at selected intervals. Another way to provide such breaks would be to produce heaters in a discontinuous fashion by stopping the flow of conductive polymer material at intervals during its extrusion onto constantly moving conductors.

Further, it has been found that any process by which a conductive material is attached to at least two conductors, and the conductive web is made to be non-continuous at points along the length of the heater, will produce the needed discontinuity. This discontinuity can be filled or covered with a non-conductive material, if desired. For example, an electrical insulation can be extruded over the heater.

DETAILED DESCRIPTION OF THE PREFERRED EMBODIMENT

Figure 1:
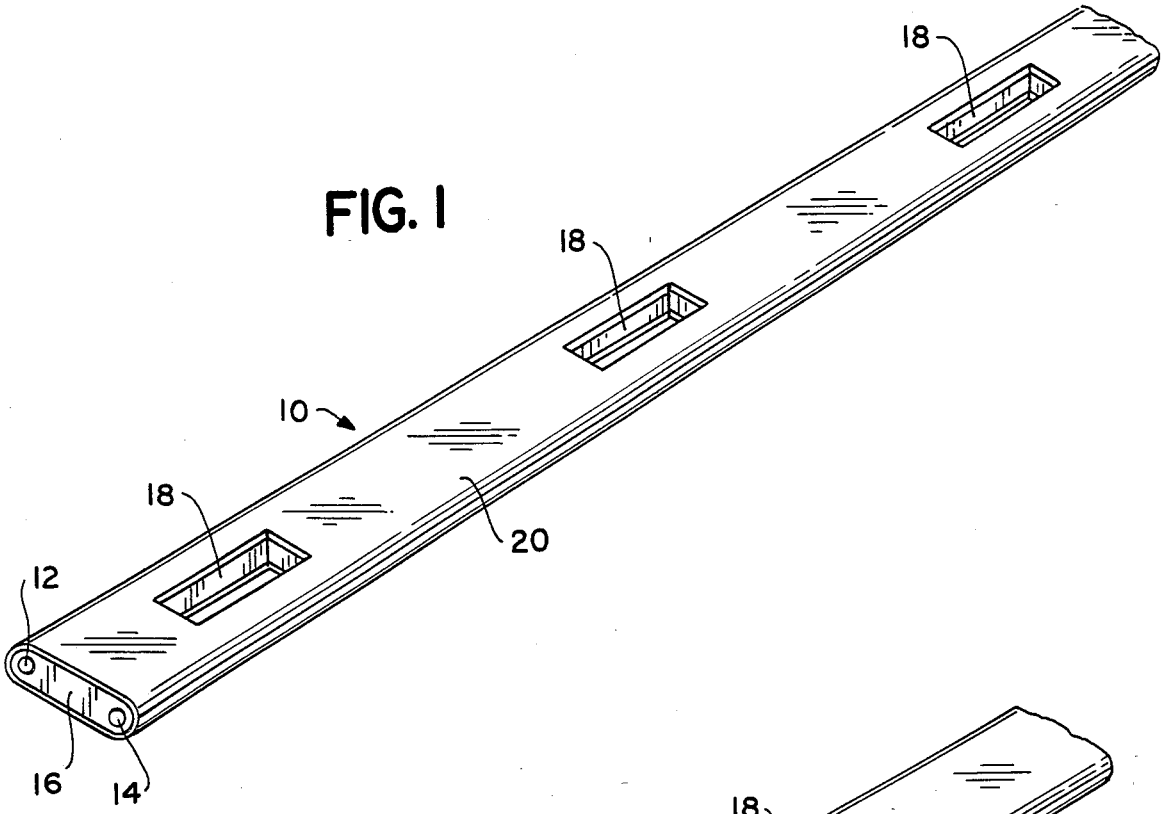
FIG. 1 is a perspective view of the self-regulating heater of the present invention, having holes disposed within the web of semi-conductive polymeric material to stop tracking up the length of the heater.
Figure 2:
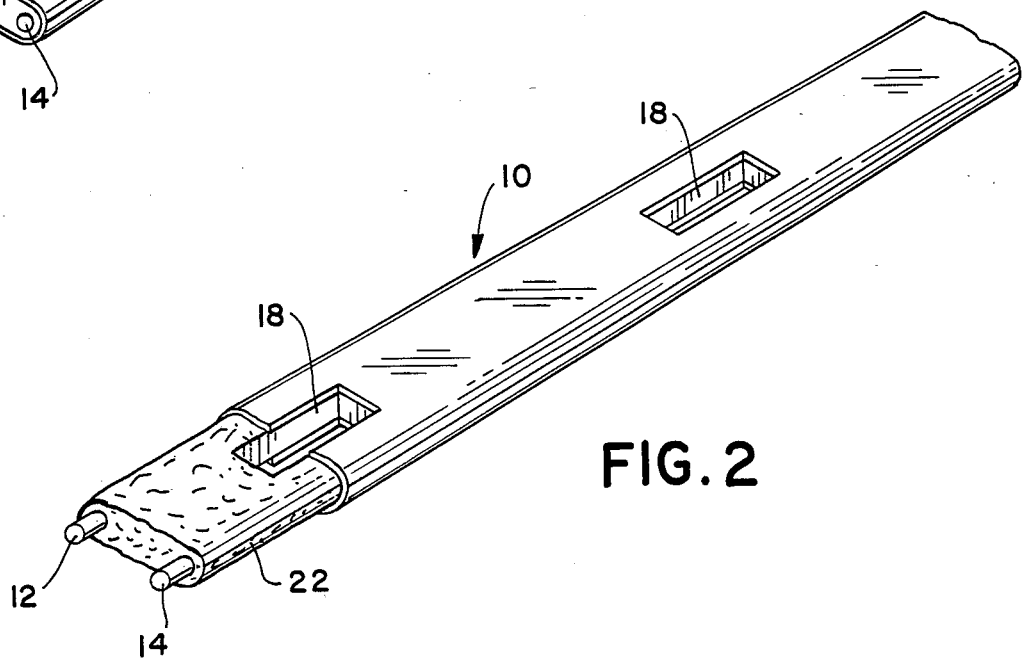
FIG. 2 depicts a schematic representation of tracking being stopped once it reaches one of the holes disposed within the heater.

Referring to FIG. 1, there is depicted a heat tape 10, comprising a pair of elongate electrical conductors 12 and 14 respectively, electrically interconnected by a semi-conductive compound, and forming a web 16 therebetween. The conductors 12, 14 are spaced apart, such that they are substantially parallel to each other along their longitudinal axes, at a selected interval which can be, for example, 0.3 inches.

The compound should be selected such that it will conduct electrical current between the two conductors 12, 14 at low temperatures, such that the combination of the compound and the conductors forms a useful heater. The semi-conductive compound also exhibits an electrical resistance which increases at higher temperatures, thereby reducing the conductivity of the compound. This reduction in conductivity automatically reduces the power output of the heat tape 10, thereby providing a self regulating heater which can be used without the use of external temperature controllers or sensors.

Preferably, the semi-conductive compound contains at least one polymeric component to promote the desired self regulating heat characteristics thereof, and an amount of electrically conductive particles dispersed therein. It has been determined that the amount of electrically conductive particles should be in the range of 17% to 25% by weight to the total weight of the compound.

The semi-conductive web 16 is made to be discontinuous at selected points along the length of the heater. These discontinuities can be provided, for example, by cutting holes or slits 18 in the heaters web 16 at periodic intervals. These holes 18 have a rectangular shape in the arrangement illustrated, but of course other shapes may be employed. Another way to provide these breaks would be to produce heaters in a discontinuous manner by stopping the flow of the conductive polymer material at intervals during its extrusion onto constantly moving conductors.

The discontinuities may be filled or covered with a non-conductive material if so desired. The heater may then be encased in a thermoplastic elastomer jacket 20 to provide insulation and protection therefor.

The heat tape 10 is connected to a voltage source (not shown) which, when applied to the heat tape 10, causes current to flow through the semi-conductive polymer compound. As the compound warms, the polymeric matrix tends to expand. This expansion of the polymeric matrix causes the electrically conductive particles to separate, thereby reducing the conductivity of the compound. As the conductivity is reduced, the current flowing through the polymeric compound, and thus the power output of the heater, is also reduced.

Wet fire conditions are set up if moisture or other electrolytes somehow penetrate the heat tape 10. Under these conditions, arcing may begin between the two conductors 12, 14, across the surface of the polymeric material. Such arcing causes the semi-conductive material to char, and excessive heat from the material in the active arcing area can ignite combustible materials in contact with the heater.

It is noteworthy that the polymeric matrix of the semi-conductive material is such that internal burning is permitted along its length. Therefore, once arcing begins, it tends to track up the length of the heater, consuming new material as it travels. Such tracking will continue until one of the discontinuities 18 in the web 16 is reached. At that point, tracking will stop, as the discontinuity 18 prohibits arcing between the two conductors 12,14.

Since arcing can start at any point within the heater, it is preferable to space the discontinuities 18 at periodic intervals along the entire length of the heater. In the preferred embodiment, the discontinuities or holes 18, are approximately 0.25 inches in width by approximately 1 inch in length. The holes 18 do not extend to the conductors such that they remain fully covered by the web compound. It has been determined that in order to achieve significant results, the discontinuities 18 should be spaced apart at intervals of no more than 6.0 inches. However, it is preferable that the average distance between discontinuities 18 be no more than 3.0 inches. In the preferred embodiment, such distance is 1.5 inches.

What is claimed is:

1. A self-regulating heater, comprising:

a pair of spaced electrical conductors;

a compound surrounding said conductors and forming a web between said conductors, said compound having the characteristic that it will conduct electrical current between said conductors at low temperatures with electrical resistance at a level such that said conductors and said compound form a useful electrical heater, said compound further having the characteristic that its electrical resistance increases at higher temperatures such that the heat output from said heater is reduced whereby said heater is self-regulating, said compound being combustible and subject to so-called "wet fires" when arcing occurs between said conductors over the surface of said web such as when moisture or other electrolyte accumulates on the ends of said conductors or at an area where said compound is worn away from said conductors, said web having spaced discontinuities formed therein that stop such "wet fires" if they should occur.

2. The self-regulating heater, as defined in claim 1, further comprising a thermoplastic elastomer jacket for providing electrical insulation to said heater.

3. The self-regulating heater, as defined in claim 1, wherein said electrical conductors are spaced apart at a distance not to exceed about 0.3 inches.

4. The self-regulating heater, as defined in claim 1, wherein said discontinuities comprise holes in said conductive web, substantially rectangular in shape.

5. The self-regulating heater, as defined in claim 4, wherein said holes have a dimension of approximately 0.25 inches in width by approximately 1 inch in length.

6. The self-regulating heater, as defined by claim 5, wherein said holes are spaced at periodic intervals along substantially the entire length of said heater.

7. The self-regulating heater, as defined in claim 6, wherein said intervals have a periodicity of approximately 1.5 inches.

8. An electrical heater comprising a pair of spaced, substantially, parallel conductors, and a semi-conductive compound surrounding, and forming a web extending between said conductors, a plurality of holes in the web at spaced intervals along the length of the heater.

9. A method of making a self-regulating heater having a heat tape that stops tracking, associated with so-called "wet fires," comprising the steps of:

extruding a semi-conductive compound about a pair of spaced electrical conductors, to form a conductive web therebetween, thereby electrically interconnecting said pair of conductors; and forming spaced discontinuities in said compound to prohibit arcing between said pair of conductors.

10. The method of making a self-regulating heater, as defined in claim 9, wherein said discontinuities are formed by cutting holes or slits in said semi-conductive compound.

11. The method of making a self-regulating heater, as defined in claim 9, wherein said discontinuities are formed by providing a discontinuous flow of said semi-conductive compound at periodic intervals during said extrusion step.

12. The method of making a self-regulating heater, as defined in claim 9, further comprising the step of extruding a non-conductive material over said heater to provide electrical insulation to said heater.

* * * * *